US007752680B2

(12) United States Patent
Bushman

(10) Patent No.: US 7,752,680 B2
(45) Date of Patent: Jul. 13, 2010

(54) PROTECTIVE-APPAREL SLEEVE AND PROTECTIVE APPAREL INCORPORATING SAME

(75) Inventor: Bradley J. Bushman, Cincinnati, OH (US)

(73) Assignee: Standard Textile Co., Inc., Cincinnati, OH (US)

( * ) Notice: Subject to any disclaimer, the term of this patent is extended or adjusted under 35 U.S.C. 154(b) by 1685 days.

(21) Appl. No.: 10/949,028

(22) Filed: Sep. 24, 2004

(65) Prior Publication Data

US 2006/0041988 A1 Mar. 2, 2006

Related U.S. Application Data

(63) Continuation-in-part of application No. 10/711,220, filed on Sep. 2, 2004.

(51) Int. Cl.
*A41D 27/12* (2006.01)

(52) U.S. Cl. ..... 2/59

(58) Field of Classification Search ..... 2/59, 2/69, 102, 108, 79, 227, 243.1
See application file for complete search history.

(56) References Cited

U.S. PATENT DOCUMENTS

| | | | |
|---|---|---|---|
| 4,040,124 | A | 8/1977 | Zoephel |
| 4,433,026 | A | 2/1984 | Molde |
| 4,561,434 | A | 12/1985 | Taylor |
| 4,822,667 | A | 4/1989 | Goad et al. |
| 4,919,998 | A | 4/1990 | Goad et al. |
| 4,991,232 | A | 2/1991 | Taylor |
| 5,001,785 | A | 3/1991 | Heiman et al. |

(Continued)

FOREIGN PATENT DOCUMENTS

DE 19932164 A1 1/2001

(Continued)

OTHER PUBLICATIONS

European Committee for Standardization, *Surgical drapes, gowns and clean air suits, used as medical devices for patients, clinical staff and equipment—Part 2: Test Methods*, prEN 13795-2, Nov. 2002.

(Continued)

*Primary Examiner*—Tejash Patel
(74) *Attorney, Agent, or Firm*—Wood, Herron & Evans, LLP

(57) ABSTRACT

A protective-apparel sleeve (10) includes a tubular inner piece (12) of membrane laminated or coated fabric and a tubular outer piece (14) of membrane laminated or coated fabric generally surrounding the tubular inner piece (12). In further detail, the tubular inner piece (12) includes a stitched seam (24) along its length, and the tubular outer piece (14) includes a stitched seam (26) along its length which is circumferentially offset from the seam (24) of the tubular inner piece (12). If desired, the stitched seams (24, 26) may be generally free of a seam sealant. The protective-apparel sleeve (10) and protective-apparel products incorporating the sleeve (10) have a significantly greater liquid-resistance than conventional stitched-seam protective-apparel sleeves and protective-apparel products incorporating such sleeves. This enhanced liquid-resistance is achieved without a significant increase in acquisition costs, processing costs, and sleeve weight, and without sacrificing the comfortable feel typically associated with stitched-seam protective-apparel sleeves and protective-apparel products incorporating such sleeves.

75 Claims, 3 Drawing Sheets

U.S. PATENT DOCUMENTS

| | | | | |
|---|---|---|---|---|
| 5,002,070 | A | 3/1991 | Taylor | |
| 5,024,851 | A | 6/1991 | Goad et al. | |
| 5,236,532 | A | 8/1993 | Taylor et al. | |
| 5,461,724 | A | 10/1995 | Wiedner et al. | |
| 5,588,155 | A | 12/1996 | Baker et al. | |
| 5,594,955 | A | 1/1997 | Sommers | |
| 5,724,674 | A | 3/1998 | Covington et al. | |
| 5,813,052 | A | 9/1998 | Taylor | |
| 5,814,413 | A | 9/1998 | Beerwart | |
| 5,879,493 | A | 3/1999 | Johnson et al. | |
| 5,924,130 | A | 7/1999 | Fragomeli | |
| 6,076,189 | A * | 6/2000 | Christman et al. | 2/158 |
| 6,530,090 | B1 | 3/2003 | Ambrose et al. | |
| 6,601,239 | B2 | 8/2003 | Drake | |
| 6,932,116 | B2 * | 8/2005 | Smith et al. | 138/98 |

FOREIGN PATENT DOCUMENTS

| | | | |
|---|---|---|---|
| EP | 0707802 | A1 | 4/1996 |

OTHER PUBLICATIONS

Association for the Advancement of Medical Instrumentation, *Liquid barrier performance and classification of protective apparel and drapes intended for use in health care facilities*, ANSI/AAMI PB70:2003.

International Search Report from PCT/US2005/029991.

Written Opinion from PCT/US2005/029991.

* cited by examiner

PROTECTIVE-APPAREL SLEEVE AND PROTECTIVE APPAREL INCORPORATING SAME

CROSS-REFERENCE TO RELATED APPLICATION

This patent document claims the benefit of, and is a continuation-in-part of, U.S. patent application Ser. No. 10/711,220 entitled "Liquid-Proof Sleeve and Protective Apparel Incorporating Same", filed on Sep. 2, 2004. The entire disclosure of U.S. patent application Ser. No. 10/711,220 is incorporated into this patent document by reference.

FIELD OF THE INVENTION

This invention is directed to liquid-resistant sleeves for protective apparel and to protective apparel incorporating such sleeves.

BACKGROUND OF THE INVENTION

In making liquid-resistant sleeves for protective apparel, the fabric for each sleeve must be cut and folded so as to form a sleeve-like shape. In addition, various sections of the sleeve fabric must be overlapped and joined, thereby resulting in the formation of one or more sleeve seams. Oftentimes, a sleeve seam is formed by overlapping particular edges of the sleeve fabric, and stitching the edges together. Such stitched-seam sleeves are particularly desirable because they are both comfortable and relatively inexpensive to produce. In forming such stitched seams, however, one or more sewing needles pierce the fabric, thereby forming a series of needle holes. And while these needle holes may be quite small, they still may serve as passageways through which a liquid undesirably may pass from the exterior to the interior of the sleeve.

In an effort to reduce the problem of liquid-permeation through stitched seams of protective-apparel sleeves, U.S. Pat. No. 4,991,232 provided a surgical gown in which each of the sleeves has an inner seam-stitched ply and an outer seam-stitched ply, with each ply made of, for example, a hydrophobic fabric, and with the seams being circumferentially offset.

More recently, users in various segments of the protective-apparel market have requested protective apparel in which the sleeves deliver a further-enhanced level of liquid resistance. In an effort to provide such an enhanced level, more than merely offsetting the seams has been required. Specifically, one or more seam sealants, such as a heat-applied tape, glue, and/or other similar materials are applied to the stitched seams. Such sealants are undesirable, however, for many reasons, including because they add to the manufacturing costs and steps involved in making such sleeves, and because they reduce the comfort of the sleeves.

Accordingly, there is a need to provide protective apparel which not only offers a further-enhanced level of liquid resistance, but also provides the high level of comfort and relatively low manufacturing expense associated with stitched-seam sleeves.

SUMMARY OF THE INVENTION

The present invention provides a sleeve and protective-apparel items incorporating such a sleeve, in which the sleeve offers a further-enhanced level of liquid resistance desired by many protective-apparel users. In addition, the invention achieves this goal without a significant increase in sleeve weight and the corresponding acquisition- and processing-costs, and without sacrificing the comfortable feel associated with the conventional stitched-seam sleeve products. To this end, and in accordance with the principles of the invention, the enhanced liquid resistance is accomplished by utilizing a first membrane laminated or coated fabric instead of the inner ply, and a second membrane laminated or coated fabric instead of the outer ply. The sleeve thus still has the needle-based stitching, with the improvement of the offset stitching, but has the advantage of providing an enhanced level of liquid resistance without further processing. Thus, if desired, the stitched seams may be generally free of a seam sealant.

By virtue of the foregoing, there are thus provided a protective-apparel sleeve and protective-apparel items incorporating such a sleeve which provide enhanced liquid-resistance while maintaining a comfortable feel, and without significantly increasing the weight and cost of the protective apparel. These and other advantages of the present invention will be apparent from the accompanying drawings and description of the drawings.

BRIEF DESCRIPTION OF THE DRAWINGS

The accompanying drawings, which are incorporated in and constitute a part of this specification, illustrate embodiments of the invention and, together with a general description of the invention given above, and the detailed description of the drawings given below, serve to explain the principles of the invention. The drawings are schematic and not to scale.

DETAILED DESCRIPTION OF THE DRAWINGS

Figure 1:
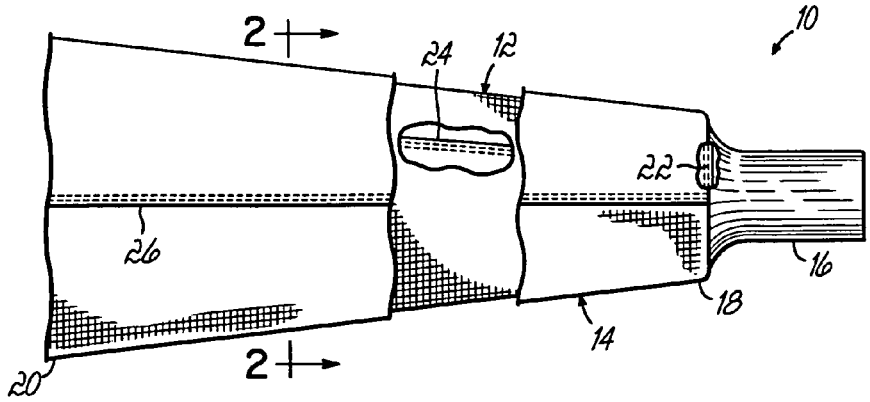
FIG. 1 is an elevational top view of a protective-apparel sleeve in accordance with the principles of the invention, in which portions of the sleeve are broken away.
Figure 2:
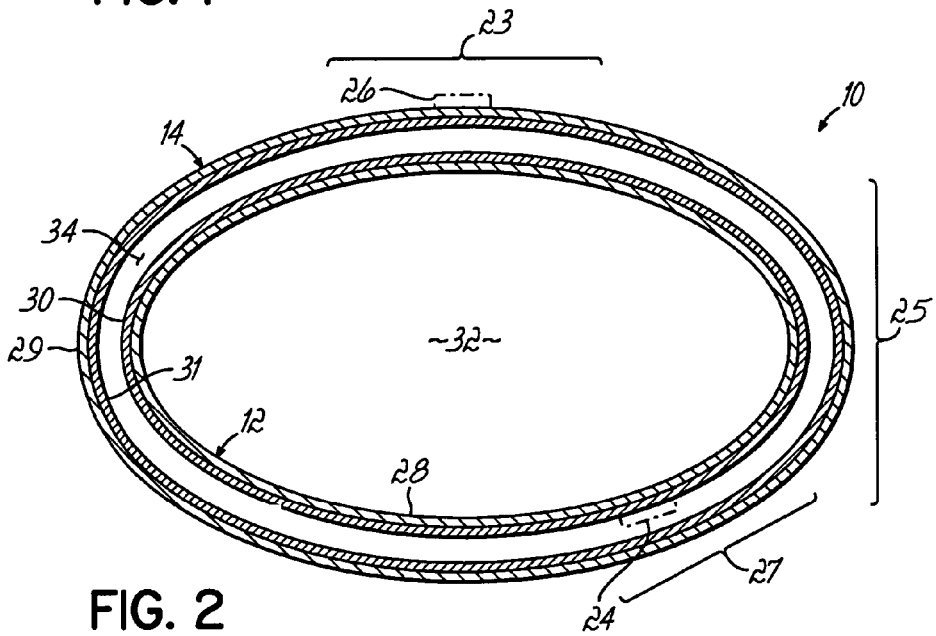
FIG. 2 is a cross-sectional view of the sleeve of FIG. 1, taken along line 2-2.

With reference to FIGS. 1 and 2, a protective-apparel sleeve 10 in accordance with the principles of the invention includes a tubular inner piece 12 comprised of a two-layer membrane laminated or coated fabric, a tubular outer piece 14 also comprised of a two-layer membrane laminated or coated fabric, generally surrounding the inner piece 12, and a cuff 16. The inner piece/outer piece combination 12, 14 has a first end 18 and a second end 20. The first end 18 includes conventional stitching 22 which connects the inner piece 12, outer piece 14, and cuff 16 together at that end 18. As shown, the second end 20 is unfinished, thereby enabling the sleeve 10 to be used in forming any of a number of different protective-apparel garments, including, for example, a sleeve protector, a surgical gown, an isolation gown, a decontamination garment, or a garment for a researcher to wear while experimenting with hazardous biomaterials. The second end 20 may be finished if desired, and the inner piece 12 and outer piece 14 may be connected at second end 20. In further detail, the inner piece 12 includes a stitched seam 24 along its length, and the outer piece 14 includes a stitched seam 26 along its length which is circumferentially offset from the seam 24 of the inner piece 12, typically between about 90° and about 180° (measured along the shortest angle between them).

As will be appreciated by one of ordinary skill, any circumferential offset which maintains the enhanced liquid-resistant character of the sleeve may be used. If desired, the offset may be about 90° or more, or about 120° or more. As best seen in FIG. 2, the inner seam 24 is circumferentially offset from the outer seam 26 by about 160°. When the sleeve 10 is used to make a protective-apparel garment, advantageously, the sleeve 10 is oriented so that, when the garment is worm, the outer seam 26 is positioned generally at the top 23 of the sleeve, and the inner seam 24 is positioned generally at the back 25 or lower-back 27 of the sleeve. (See FIG. 7). Each of the seams independently may be any suitable, conventional stitched seam, made using any suitable method(s). By way of example, the seams may be double-needle, flat-felled seams. As one of ordinary skill also will appreciate, although each of the tubular inner- and outer-pieces 12, 14 of the sleeve 10 is tapered (FIG. 1), any suitable tubular shape may be used. For example, a tubular inner piece and/or a tubular outer piece may have a constant cross-sectional diameter along its length, or may have an articulated elbow section.

With reference to FIG. 2, the two-layer inner piece 12 and the two-layer outer piece 14 each include a fabric layer 28, 29 and a membrane layer 30, 31. The inner piece 12 defines an interior space 32 for receiving at least a portion of a user's arm (not shown), and the fabric layer 28 of the two-layer inner piece 12 faces toward this interior space 32. The fabric layer 29 of the two-layer outer piece 14 faces outward, thereby forming an exterior surface of the sleeve 10. The membranes 30, 31 of the inner- and outer-pieces 12, 14 are thus in confronting relationship to define a region therebetween. For purposes of illustration, the region is shown as being an annular space 34 between the inner- and outer-pieces 12, 14—at least at a particular point (line 2-2) along the length of the sleeve 10. However, it should be understood that the pieces 12, 14 may be touching one another at any given time, and that such an annular space 34 may not exist. For example, the pieces 12, 14 may be sized so that they typically are in contacting relationship along at least much of the sleeve length—even though they may, for example, be attached to each other only at the first- and/or second-ends 18, 20. Also, when a user wears a protective-apparel garment incorporating the sleeve 10, the locations at which inner piece 12 touches outer piece 14 may change with the body movements of the user. For sake of illustration, each of FIGS. 3-6 also shows an annular space between the particular inner- and outer-pieces of the given sleeve embodiment. However, these annular spaces may or may not be present, as noted above.

Figure 3:
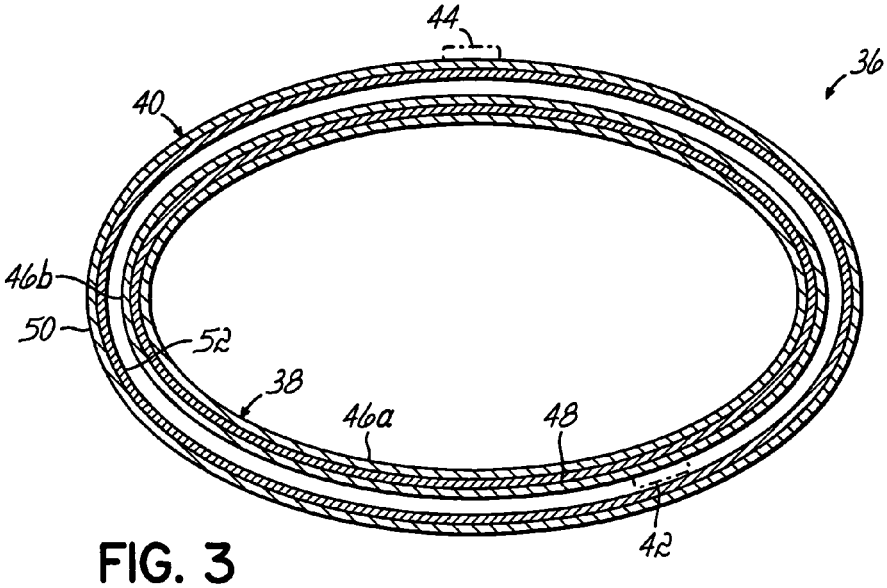
FIG. 3 is a cross-sectional view, similar to FIG. 2, of another embodiment of a sleeve of the present invention.

With reference to FIG. 3, a protective-apparel sleeve 36 includes a three-layer inner piece 38 surrounded by a two-layer outer piece 40. The inner piece 38 includes a stitched seam 42, and the outer piece 40 includes a stitched seam 44 which is circumferentially offset from the seam 42 by about 160°. The three-layer inner piece 38 includes first- and second-fabric layers 46*a, b* and a membrane layer 48 therebetween; and the two-layer outer piece 40 includes a fabric layer 50 and a membrane layer 52, with the fabric 50 facing outward, thereby forming an exterior surface of the sleeve 36.

Figure 4:
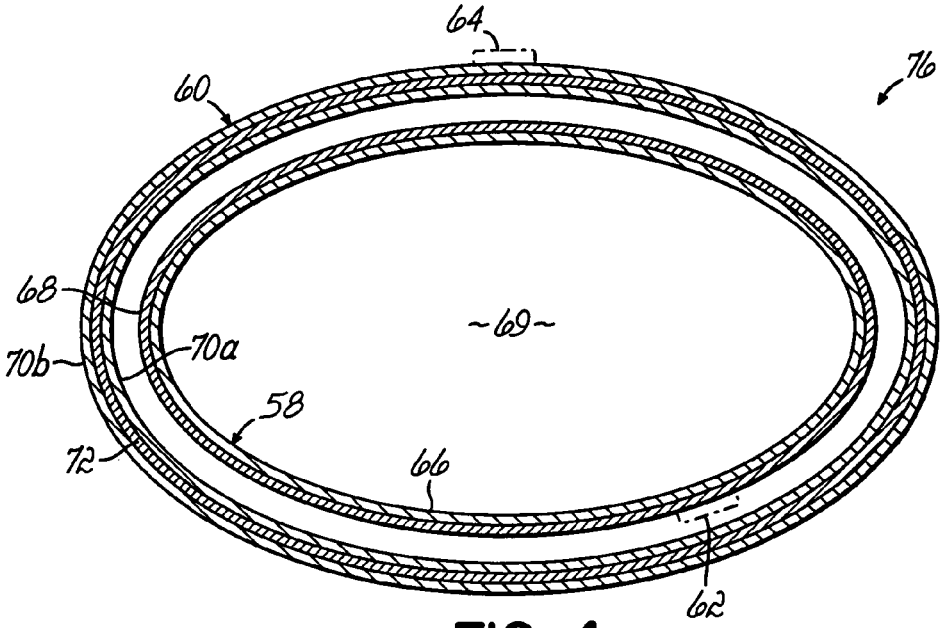
FIG. 4 is a cross-sectional view, similar to FIG. 2, of a further embodiment of a sleeve of the present invention.

With reference to FIG. 4, a protective-apparel sleeve 56 includes a two-layer inner piece 58 surrounded by a three-layer outer piece 60. The inner piece 58 includes a stitched seam 62, and the outer piece 60 includes a stitched seam 64 which is circumferentially offset from the seam 62 by about 160°. The two-layer inner piece 58 is made up of a fabric layer 66 and a membrane layer 68, with the fabric layer 66 facing toward the interior space 69 and the membrane layer 68 facing outward toward the outer piece 60; and the three-layer outer piece 60 is made up of first and second fabric layers 70*a, b* and a membrane layer 72 therebetween.

Figure 5:
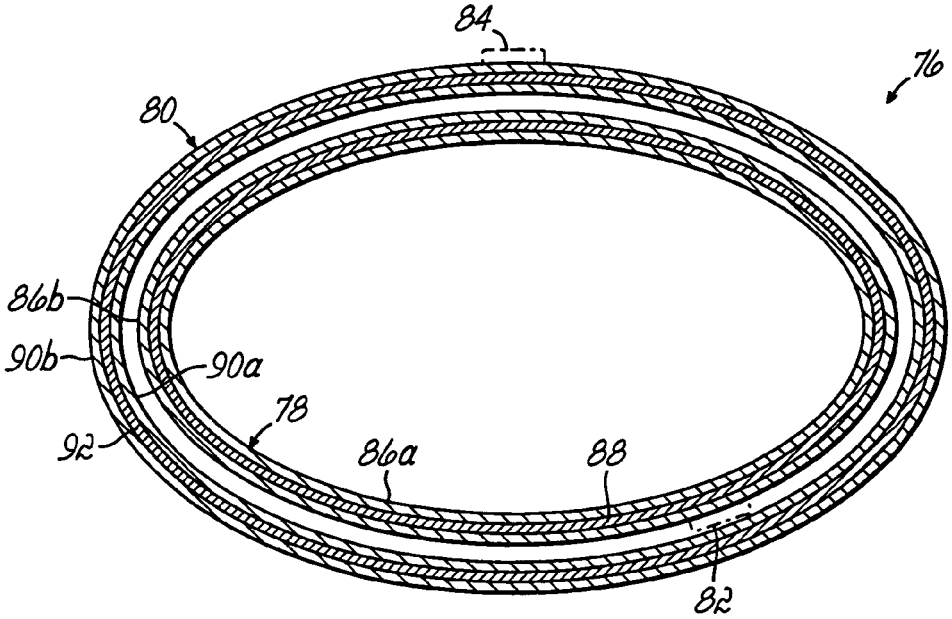
FIG. 5 is a cross-sectional view, similar to FIG. 2, of an additional embodiment of a sleeve of the present invention.

With reference to FIG. 5, a protective-apparel sleeve 76 includes a three-layer inner piece 78 surrounded by a three-layer outer piece 80. The inner piece 78 includes a stitched seam 82, and the outer piece 80 includes a stitched seam 84 which is circumferentially offset from the seam 82 by about 160°. Each of the three-layer pieces 78, 80 is formed of first and second fabric layers 86*a, b*, and 90*a, b* and a membrane layer 88, 92 therebetween.

Figure 6:
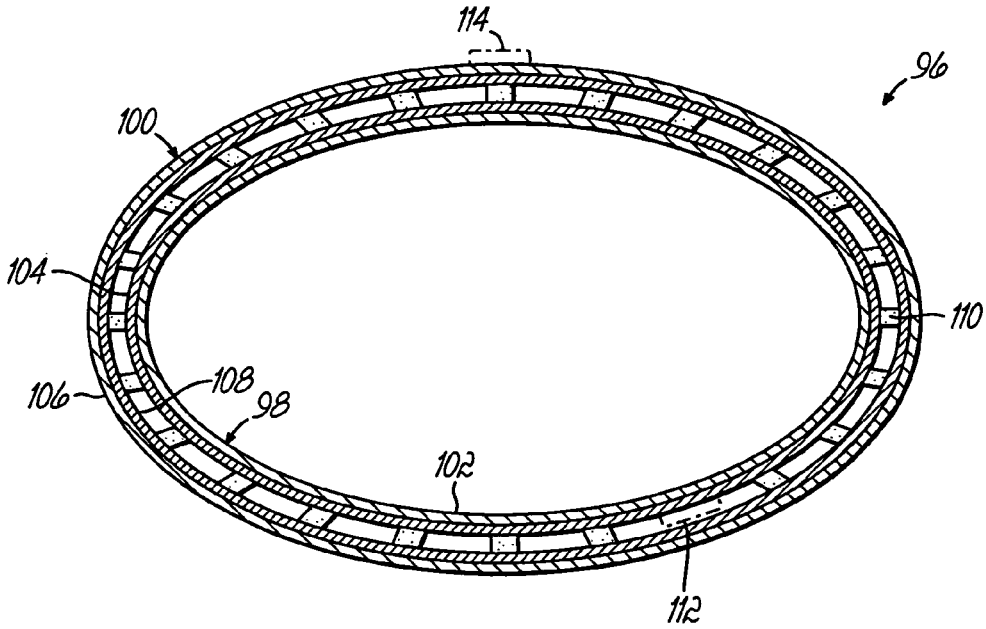
FIG. 6 is a cross-sectional view, similar to FIG. 2, of yet another embodiment of a sleeve of the present invention.

With reference to FIG. 6, a protective-apparel sleeve 96 includes a two-layer inner piece 98 surrounded by, and adhesively bonded to, a two-layer outer piece 100. The inner- and outer-pieces 98, 100 each include a fabric layer 102, 106 and a membrane layer 104, 108. The membrane layers 104, 108 are in confronting relationship and are in contact as well, being adhesively bonded together, as at 110. Any suitable adhesive and adhesive-application method(s) may be used. For example, a reactive hot-melt adhesive may be applied using a dot-matrix technique. The inner piece 98 includes a stitched seam 112, and the outer piece 100 includes a stitched seam 114 which is circumferentially offset from the seam 112 by about 160°. Alternatively, the membrane layers 104, 108 may be fused together (not shown) using any suitable method(s). For example, if desired, thermal fusing or ultrasonic fusing may be used.

The sleeves described above and depicted in FIGS. 1-6 provide an enhanced level of liquid resistance desired by many protective-apparel users. Moreover, this enhanced liquid resistance is achieved without the use of a seam sealant. In addition, many if not most of these embodiments satisfy one or more of the following liquid-resistance standards, as identified below: "European liquid-resistance standard EN 13795"; "liquid-proof standard"; and "Level-4 barrier standard". The term "European liquid resistance standard EN 13795", as used herein, means the resistance-to-liquid-penetration portion (test and criteria) for a critical area of a high-performance surgical gown, as identified in European Standard EN 13795 entitled "Surgical drapes, gowns and clean air suits, used as medical devices, for patients, clinical staff and equipment". European Standard EN 13795 is incorporated into this patent document in its entirety by reference. As used herein, the term "liquid-proof standard" means a constant hydrostatic pressure of 2 psi for five minutes without liquid strikethrough. The term "Level-4-barrier standard", as used herein, means the Level-4 barrier-performance standard for protective apparel set forth in ANSI/AAMI standard PB70:2003 entitled "Liquid barrier performance and classification of protective apparel and drapes intended for use in health care facilities", that standard being incorporated into this patent document in its entirety by reference. The test method for determining ANSI/AAMI PB70:2003 Level-4 barrier-performance for protective apparel is that of ASTM designation 1671-03, that test method also being incorporated into this patent document in its entirety by reference.

The membrane laminated or coated fabrics may be made by any suitable lamination method(s), coating method(s), or combinations thereof, as will be appreciated by those of ordinary skill. For example, a two-layer fabric may be formed by laminating a membrane layer and a fabric layer together. If desired, these two layers may be adhesively bonded together. In one such adhesive-bonding method, a reactive hot melt adhesive may be applied to one or both of the layers, with the adhesive advantageously being applied in a dot matrix array. If a coating method is used, typically a membrane-forming material, usually in a liquefied or semi-solid state, is applied directly to a surface of the fabric layer.

Likewise, a three-layer fabric may be made using any suitable lamination or coating methods, or combinations thereof. For example, a first fabric layer may be laminated to one side of a membrane layer, and a second fabric layer simultaneously may be laminated to the opposing side of the membrane layer. Alternatively, a three-layer fabric may be made by first forming a two-layer fabric, for example as described in the preceding paragraph, and then bonding together (via one or more lamination and/or coating techniques) a second fabric layer and the exposed membranous layer side of the two-layer fabric.

The fabric and membrane layers may be made of any suitable material(s). For example, if desired, any given fabric layer independently may be made of one or more of a polyester, a co-polyester, a polypropylene, a nylon, a polyethylene, and a cotton. Likewise, any given membrane layer independently may be formed of, for example, one or more of a polyurethane, a polyester, a nylon, and a polyethylene. By way of further example, a particular two-layer fabric may include a polyester warp-knit fabric layer and a polyurethane membrane layer; and a three-layer fabric may include first- and second-polyester warp-knit fabric layers and a polyurethane membrane layer therebetween.

Figure 7:
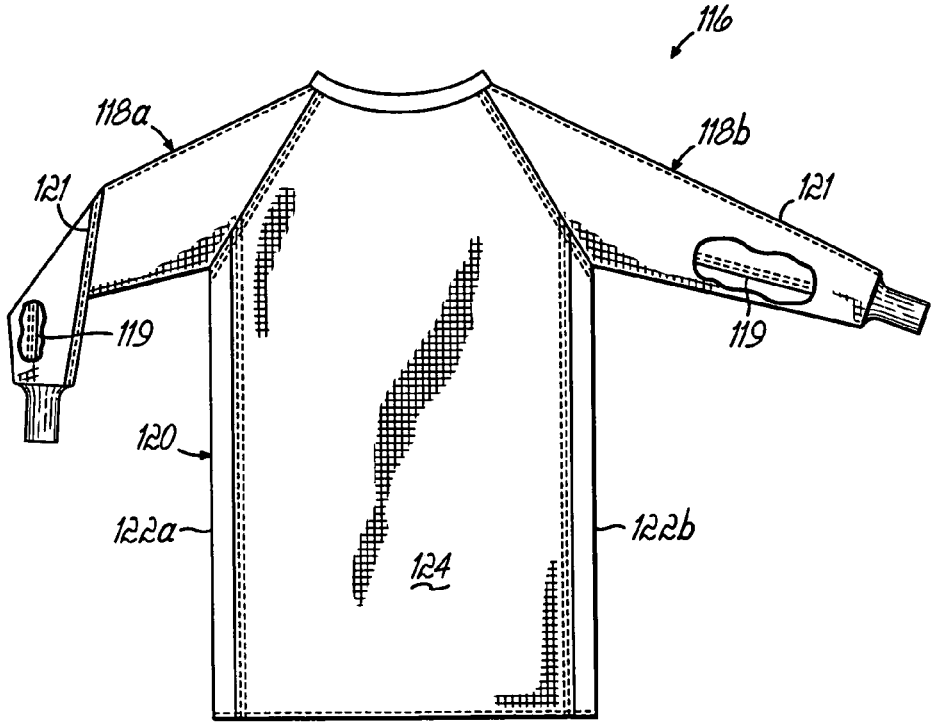
FIG. 7 is an elevational front view of a surgical gown having a sleeve in accordance with the principles of the invention.

With reference to FIG. 7, a surgical gown 116 in accordance with the principles of the invention includes first- and second-protective-apparel sleeves 118*a, b* stitched to a torso section 120. The sleeves 118*a, b* provide enhanced liquid resistance, being made of membrane-laminated-or-coated-fabric inner- and outer-pieces and circumferentially-offset stitched seams 119, 121 in accordance with the principles of the invention such as described above. By way of example, the sleeves 118*a, b* could each be as shown in FIGS. 1 and 2 hereof. The torso section 120, itself, includes first- and second-side panels 122*a, b* stitched to a front panel 124. The torso section 120 may be made of any suitable material or combination of materials. In addition, the surgical gown 116 may be made by attaching the component pieces (for example, the sleeves 118*a, b*, front panel 124, and side panels 122*a, b*) using any conventional method or combination of such methods.

By virtue of the foregoing, there is provided a protective-apparel sleeve, as well as protective-apparel products which incorporate the sleeve, all of which have advantages over prior protective-apparel sleeves and protective-apparel products incorporating those sleeves.

While the present invention has been illustrated by the description of embodiments, and while the illustrative embodiments have been described in considerable detail, it is not the intention of the inventor to restrict or in any way limit the scope of the appended claims to such detail. Additional advantages and modifications readily will appear to those skilled in the art. The invention in its broader aspects is therefore not limited to the specific details, representative apparatus and methods, and illustrative examples shown and described. Accordingly, departures may be made from such details without departing from the spirit or scope of the inventor's general inventive concept.

What is claimed is:

1. A protective-apparel sleeve, comprising:

a tubular inner piece of membrane laminated or coated fabric including a stitched seam along its length, the inner-piece including a first fabric layer and a membrane layer and defining an interior space for receiving at least a portion of a user's arm, the first fabric layer of the inner-piece membrane laminated or coated fabric facing the interior space; and a tubular outer piece of membrane laminated or coated fabric generally surrounding substantially the length of the inner piece, the outer piece including a stitched seam along its length which is circumferentially offset from the seam of the inner piece, the stitched seams being generally free of a seam sealant.

2. The sleeve of claim 1 wherein the sleeve satisfies European liquid-resistance standard EN 13795.

3. The sleeve of claim 1 wherein the sleeve satisfies the liquid-proof standard.

4. The sleeve of claim 1 wherein the sleeve satisfies the Level-4-barrier standard.

5. The sleeve of claim 1 wherein the inner piece is connected to the outer piece.

6. The sleeve of claim 5 wherein the sleeve includes a first end and a second end, and the inner piece is connected to the outer piece at the first end.

7. The sleeve of claim 6 wherein the first end of the sleeve is a cuff end.

8. The sleeve of claim 6 wherein the inner piece is connected to the outer piece at the second end.

9. The sleeve of claim 5 wherein the inner piece is bonded to the outer piece.

10. The sleeve of claim 1 wherein the outer-piece membrane laminated or coated fabric includes a fabric layer and a membrane layer.

11. The sleeve of claim 10 wherein the fabric layer of the outer-piece membrane laminated or coated fabric faces exteriorly of the sleeve.

12. The sleeve of claim 1 wherein the inner-piece membrane laminated or coated fabric includes a second fabric layer, the membrane layer being between the first and second fabric layer.

13. The sleeve of claim 1 wherein the outer-piece membrane laminated or coated fabric includes first and second fabric layers and a membrane layer therebetween.

14. The sleeve of claim 13 wherein one of the fabric layers of the outer-piece membrane laminated or coated fabric faces exteriorly of the sleeve.

15. The sleeve of claim 1 wherein the inner and outer pieces define a region therebetween, the membrane layers of the pieces confronting the region.

16. The sleeve of claim 15 wherein at least one of the pieces further includes a second fabric layer, the membrane layer being positioned between the first and second fabric layers of the one of the pieces.

17. The sleeve of claim 16 wherein the second fabric layer is positioned between the tubular region and the membrane layer.

18. The sleeve of claim 1 wherein the fabric is formed of a material selected from the group consisting of a polyester, a co-polyester, a polypropylene, a nylon, a polyethylene, a cotton, and combinations thereof.

19. The sleeve of claim 10 wherein the fabric is formed of a material selected from the group consisting of a polyester, a co-polyester, a polypropylene, a nylon, a polyethylene, a cotton, and combinations thereof.

20. The sleeve of claim 1 wherein the membrane is formed of a material selected from the group consisting of a polyurethane, a polyester, a nylon, a polyethylene, and combinations thereof.

21. The sleeve of claim 10 wherein the membrane is formed of a material selected from the group consisting of a polyurethane, a polyester, a nylon, a polyethylene, and combinations thereof.

22. The sleeve of claim 1 further including a cuff.

23. A protective-apparel garment, comprising:

a torso section;

a first protective-apparel sleeve connected to the torso section; and a second protective-apparel sleeve connected to the torso section, the first and second sleeves each comprising:

a tubular inner piece of membrane laminated or coated fabric including a stitched seam along its length; and a tubular outer piece of membrane laminated or coated fabric generally surrounding the inner piece, the outer piece including a stitched seam along its length which is circumferentially offset from the seam of the inner piece, the stitched seams being generally free of a seam sealant.

24. The garment of claim 23 wherein the sleeves each include a first end and a second end, the second end of each sleeve being stitched to the torso section.

25. The garment of claim 23 wherein the sleeves satisfy European liquid-resistance standard EN 13795.

26. The garment of claim 23 wherein the sleeves satisfy the liquid-proof standard.

27. The garment of claim 23 wherein the sleeves satisfy the Level-4-barrier standard.

28. The garment of claim 23 wherein, for each sleeve, the inner piece is connected to the outer piece.

29. The garment of claim 28 wherein the sleeves each include a first end and a second end, and, for each sleeve, the inner piece is connected to the outer piece at the first and second ends.

30. The garment of claim 28 wherein, for each sleeve, the inner piece is bonded to the outer piece.

31. The garment of claim 23 wherein, for each sleeve, the inner-piece membrane laminated or coated fabric includes a fabric layer and a membrane layer.

32. The garment of claim 31 wherein, for each sleeve, the inner piece defines an interior space for receiving at least a portion of a user's arm, the fabric layer of the inner-piece membrane laminated or coated fabric facing the interior space.

33. The garment of claim 23 wherein, for each sleeve, the outer-piece membrane laminated or coated fabric includes a fabric layer and a membrane layer.

34. The garment of claim 33 wherein, for each sleeve, the fabric layer of the outer-piece membrane laminated or coated fabric faces exteriorly of the sleeve.

35. The garment of claim 23 wherein, for each sleeve, the inner-piece membrane laminated or coated fabric includes first and second fabric layers and a membrane layer therebetween.

36. The garment of claim 35 wherein, for each sleeve, the inner piece defines an interior space for receiving at least a portion of a user's arm, one of the fabric layers of the inner-piece membrane laminated or coated fabric facing the interior space.

37. The garment of claim 23 wherein, for each sleeve, the outer-piece membrane laminated or coated fabric includes first and second fabric layers and a membrane layer therebetween.

38. The garment of claim 37 wherein, for each sleeve, one of the fabric layers of the outer-piece membrane laminated or coated fabric faces exteriorly of the sleeve.

39. The garment of claim 23 wherein, for each sleeve, the inner-piece membrane laminated or coated fabric and the outer-piece membrane laminated or coated fabric each include a first fabric layer and a membrane layer.

40. The garment of claim 39 wherein, for each sleeve, the inner and outer pieces define a tubular region therebetween, the membrane layers of the pieces confronting the tubular region.

41. The garment of claim 40 wherein, for each sleeve, at least one of the pieces further includes a second fabric layer, the membrane layer being positioned between the first and second fabric layers of the one of the pieces.

42. The garment of claim 41 wherein, for each sleeve, the second fabric layer is positioned between the tubular region and the membrane layer.

43. The garment of claim 31 wherein the fabric is formed of a material selected from the group consisting of a polyester, a co-polyester, a polypropylene, a nylon, a polyethylene, a cotton, and combinations thereof.

44. The garment of claim 33 wherein the fabric is formed of a material selected from the group consisting of a polyester, a co-polyester, a polypropylene, a nylon, a polyethylene, a cotton, and combinations thereof.

45. The garment of claim 39 wherein the fabric is formed of a material selected from the group consisting of a polyester, a co-polyester, a polypropylene, a nylon, a polyethylene, a cotton, and combinations thereof.

46. The garment of claim 31 wherein the membrane is formed of a material selected from the group consisting of a polyurethane, a polyester, a nylon, a polyethylene, and combinations thereof.

47. The garment of claim 33 wherein the membrane is formed of a material selected from the group consisting of a polyurethane, a polyester, a nylon, a polyethylene, and combinations thereof.

48. The garment of claim 39 wherein the membrane is formed of a material selected from the group consisting of a polyurethane, a polyester, a nylon, a polyethylene, and combinations thereof.

49. The garment of claim 24 further including a cuff connected to the first end of each sleeve.

50. A protective-apparel sleeve, comprising:

a tubular inner piece of membrane laminated or coated fabric including a stitched seam along its length, the inner-piece including a first fabric layer and a membrane layer and defining an interior space for receiving at least a portion of a user's arm, the first fabric layer of the inner-piece membrane laminated or coated fabric facing the interior space; and a tubular outer piece of membrane laminated or coated fabric generally surrounding substantially the length of the inner piece, the outer piece including a stitched seam along its length which is circumferentially offset from the seam of the inner piece.

51. The garment of claim 23, the tubular outer piece of each sleeve surrounding substantially the length of the inner piece.

52. The garment of claim 23, the stitched seams of the tubular inner and outer pieces of each sleeve being in substantially parallel relation.

53. A protective-apparel sleeve, comprising:

a tubular inner piece of membrane laminated or coated fabric including a stitched seam along its length, the inner-piece including a first fabric layer and a membrane layer and defining an interior space for receiving at least a portion of a user's arm, the first fabric layer of the inner-piece membrane laminated or coated fabric facing the interior space; and a tubular outer piece of membrane laminated or coated fabric generally surrounding the inner piece, the outer piece including a stitched seam along its length which is circumferentially offset from and in substantially parallel relation to the seam of the inner piece, the stitched seams being generally free of a seam sealant.

54. The sleeve of claim 53 wherein the sleeve satisfies European liquid-resistance standard EN 13795.

55. The sleeve of claim 53 wherein the sleeve satisfies the liquid-proof standard.

56. The sleeve of claim 53 wherein the sleeve satisfies the Level-4-barrier standard.

57. The sleeve of claim 53 wherein the inner piece is connected to the outer piece.

58. The sleeve of claim 57 wherein the sleeve includes a first end and a second end, and the inner piece is connected to the outer piece at the first end.

59. The sleeve of claim 58 wherein the first end of the sleeve is a cuff end.

60. The sleeve of claim 58 wherein the inner piece is connected to the outer piece at the second end.

61. The sleeve of claim 57 wherein the inner piece is bonded to the outer piece.

62. The sleeve of claim 53 wherein the outer-piece membrane laminated or coated fabric includes a fabric layer and a membrane layer.

63. The sleeve of claim 62 wherein the fabric layer of the outer-piece membrane laminated or coated fabric faces exteriorly of the sleeve.

64. The sleeve of claim 53 wherein the inner-piece membrane laminated or coated fabric includes a second fabric layer, the membrane layer being between the first and second fabric layer.

65. The sleeve of claim 53 wherein the outer-piece membrane laminated or coated fabric includes first and second fabric layers and a membrane layer therebetween.

66. The sleeve of claim 65 wherein one of the fabric layers of the outer-piece membrane laminated or coated fabric faces exteriorly of the sleeve.

67. The sleeve of claim 53 wherein the inner and outer pieces define a region therebetween, the membrane layers of the pieces confronting the region.

68. The sleeve of claim 67 wherein at least one of the pieces further includes a second fabric layer, the membrane layer being positioned between the first and second fabric layers of the one of the pieces.

69. The sleeve of claim 68 wherein the second fabric layer is positioned between the tubular region and the membrane layer.

70. The sleeve of claim 53 wherein the fabric is formed of a material selected from the group consisting of a polyester, a co-polyester, a polypropylene, a nylon, a polyethylene, a cotton, and combinations thereof.

71. The sleeve of claim 62 wherein the fabric is formed of a material selected from the group consisting of a polyester, a co-polyester, a polypropylene, a nylon, a polyethylene, a cotton, and combinations thereof.

72. The sleeve of claim 53 wherein the membrane is formed of a material selected from the group consisting of a polyurethane, a polyester, a nylon, a polyethylene, and combinations thereof.

73. The sleeve of claim 62 wherein the membrane is formed of a material selected from the group consisting of a polyurethane, a polyester, a nylon, a polyethylene, and combinations thereof.

74. The sleeve of claim 53 further including a cuff.

75. The sleeve of claim 53 wherein the tubular outer piece of membrane laminated or coated fabric generally surrounds substantially the length of the inner piece.

* * * * *